US007772496B2

(12) United States Patent
Morijiri

(10) Patent No.: US 7,772,496 B2
(45) Date of Patent: Aug. 10, 2010

(54) FLAT CABLE

(75) Inventor: Daisuke Morijiri, Ibaraki (JP)

(73) Assignee: Junkosha, Fukuda, Kasama-shi, Ibaraki (JP)

( * ) Notice: Subject to any disclaimer, the term of this patent is extended or adjusted under 35 U.S.C. 154(b) by 136 days.

(21) Appl. No.: 11/994,472

(22) PCT Filed: Jul. 3, 2006

(86) PCT No.: PCT/JP2006/313622

§ 371 (c)(1),
(2), (4) Date: Jan. 2, 2008

(87) PCT Pub. No.: WO2007/004723

PCT Pub. Date: Jan. 11, 2007

(65) Prior Publication Data

US 2009/0114415 A1 May 7, 2009

(30) Foreign Application Priority Data

Jul. 5, 2005 (JP) ..... 2005-196873

(51) Int. Cl.
*H01B 7/00* (2006.01)

(52) U.S. Cl. ..... 174/117 R; 174/117 F

(58) Field of Classification Search ..... 174/74 R, 174/78, 84 R, 84 C, 88 R, 88 C; 29/861, 29/867, 827, 828, 331
See application file for complete search history.

(56) References Cited

U.S. PATENT DOCUMENTS 5,940,963 A * 8/1999 Tolmie et al. ..... 29/828
6,148,510 A * 11/2000 Yokoi et al. ..... 29/828
6,326,549 B1 * 12/2001 Kunii et al. ..... 174/88 C
6,631,554 B1 * 10/2003 Sato et al. ..... 29/828

* cited by examiner

*Primary Examiner*—William H Mayo, III
(74) *Attorney, Agent, or Firm*—Collen IP; Donald J. Ranft

(57) ABSTRACT

A flat cable in which at least end portions of a plurality of coaxial cables are securely arranged in parallel on a sheet is characterized in that a flat cable edge-machined portion for electric connection of the coaxial cables is formed at the end portion of the plurality of coaxial cables, and a part of the sheet is made to remain in a band shape across an entire width of the flat cable between a machined edge portion of the edge-machined portion and a distal end of the flat cable, and a jacket of the coaxial cable is secured to the band-shaped sheet.

4 Claims, 4 Drawing Sheets

FLAT CABLE

TECHNICAL FIELD

The present invention relates to a flat cable having a plurality of coaxial cables arranged in parallel on a sheet.

BACKGROUND ART

A coaxial cable comprising a center conductor covered with a dielectric layer whose outer surface is covered with a shield layer having a conductive wire, and a covering (jacket) covering the outer surface of the shield layer is generally known and is widely used as a high-frequency transmission line. Recently, diameter of the coaxial cable is becoming narrower; for example, a very narrow coaxial cable whose center conductor has a diameter of 0.1 mm or less and whose outer surface has a diameter of about 0.35 mm is being used in electronic devices, such as a compact notebook type personal computer and a cellular phone.

In those electronic devices, for example, a plurality of coaxial cables are used to electrically connect the liquid crystal display section of a notebook type personal computer to the main body portion thereof, and the wiring and connection become complex. As means of easily and surely achieving such complex connection, a flat cable comprising a plurality of coaxial cables held in parallel on the same plane is proposed in JP-A-2004-273333.

At the end portion of the coaxial cable of the conventional flat cable, an outer insulating coat (jacket) and a shield layer are peeled within a range of a first predetermined length from the tip to expose an inner insulating coat (dielectric layer), thereby forming a press fitting portion, and an outer insulating coat (jacket) is peeled, leaving an outer insulating coat (jacket) of a predetermined width on the tip side, within a range of a second predetermined length from an inner end of the press fitting portion, thereby forming a ground connection portion.

According to the flat cable with such a structure, the shield layer exposed at the ground connection portion is held by the outer insulating coat (jacket) of a predetermined width left on the tip side, so that multiple laterally wound narrow electric wires which form the shield layer can be prevented from raveling apart. However, a plurality of coaxial cables are likely to be separated from one another at the end portion of the flat cable, thus making it difficult to accurately hold the pitches formed among the coaxial cables. This brings about a problem of reducing the reliability of connection at the time of making press fitting connection of a connector to the tip of the flat cable and the reliability of connection at the time of connecting the shield layer to the ground. In a case where the tip of the flat cable is connected to press fitting pins of the connector which are arranged at equal intervals, for example, when the individual coaxial cables are separated apart, the work of inserting the coaxial cables into the press fitting pins becomes significantly hard, and the coaxial cables may come off the press fitting pins at the worst, causing a conductive failure.

DISCLOSURE OF INVENTION

The present invention has been made in view of various problems mentioned above, and it is an object of the present invention to provide a flat cable which makes it possible to well keep the pitch accuracy among a plurality of coaxial cables of the flat cable, and prevent separation of the outer conductors of the coaxial cables at the time of performing a complex and troublesome end process for the flat cable of the aforementioned kind, and makes it possible to keep the individual coaxial cables at predetermined positions, keep the pitch accuracy, and easily and surely achieve complex and troublesome connection even at the tip portions of the coaxial cables.

To achieve the object, a flat cable of the present invention in which at least end portions of a plurality of coaxial cables are securely arranged in parallel on a sheet is characterized in that the sheet is made to remain in a band shape across an entire width of the flat cable, at a middle portion of a flat cable edge-machined portion for electric connection of the coaxial cables.

Accordingly, a plurality of coaxial cables exposed at an end portion of the flat cable by the cable end process have their middle portions, fixed to the sheet, made to remain in a band shape. This makes it difficult for the coaxial cables to be separated part at the end portion of the flat cable, and making it possible to well keep the pitch accuracy among the coaxial cables and easily and surely achieve complex and troublesome electric connection.

It is characterized in that the coaxial cables on the band-shaped sheet has not been subjected to a cable end process. Accordingly, the jackets of a plurality of exposed coaxial cables at the band-shaped sheet portion are kept fixed to the band-shaped sheet portion, thus making it possible to put the coaxial cables together at the end portion of the flat cable.

It is characterized in that the a dielectric layer of the coaxial cable, or the dielectric layer and a center conductor are exposed between the band-shaped sheet and a distal end of the flat cable, and a shield layer of the coaxial cable is exposed between the band-shaped sheet and a machined edge portion of the flat cable edge-machined portion. This makes it possible to prevent raveling of multiple laterally wound narrow conductive wires which form the shield layer.

It is characterized in that a metal bar for connection to the shield layer is connected between the band-shaped sheet and the machined edge portion of the flat cable edge-machined portion for collective grounding. Accordingly, the metal bar can be easily disposed at a predetermined position between the band-shaped sheet and the machined edge portion of the flat cable edge-machined portion by the guide function therebetween, thereby making it possible to easily and surely achieve ground connection of the shield layer.

BEST MODE FOR CARRYING OUT THE INVENTION

An embodiment of a flat cable according to the present invention will now be described. The embodiment which will be described hereinafter does not limit the subject matters in the claims, and all the combination of features explained in the description of the embodiment should not necessarily be essential to means of solving the present invention.

Figure 1:
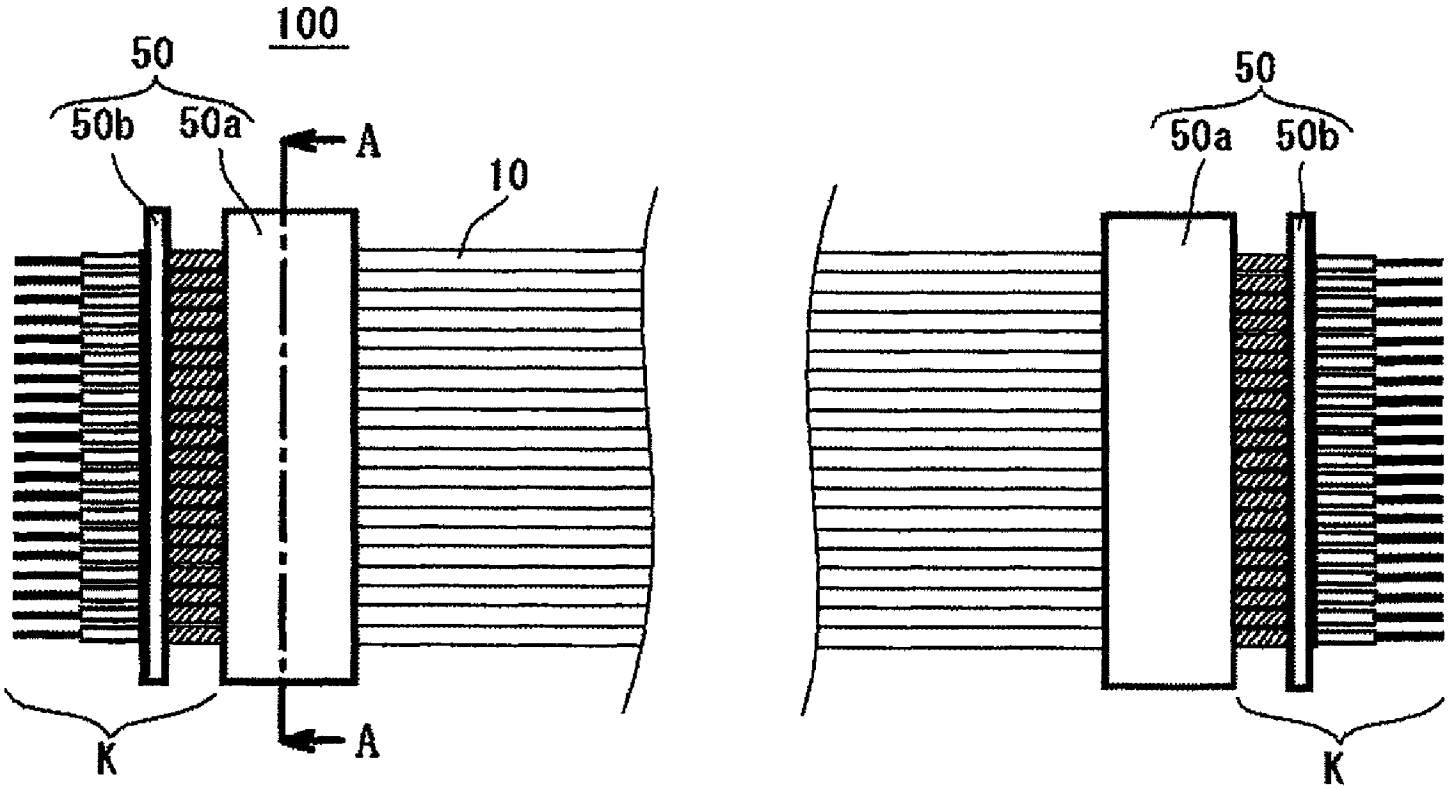
FIG. 1 is a plan view showing an embodiment of a flat cable according to the present invention.
Figure 2:
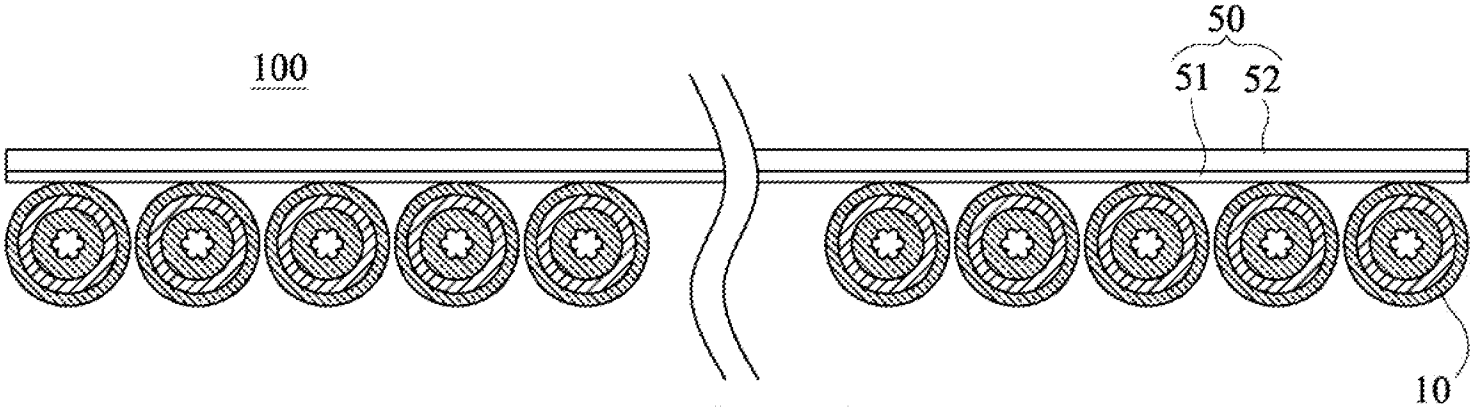
FIG. 2 is a cross-sectional view of the flat cable in FIG. 1 along line A-A.
Figure 3:
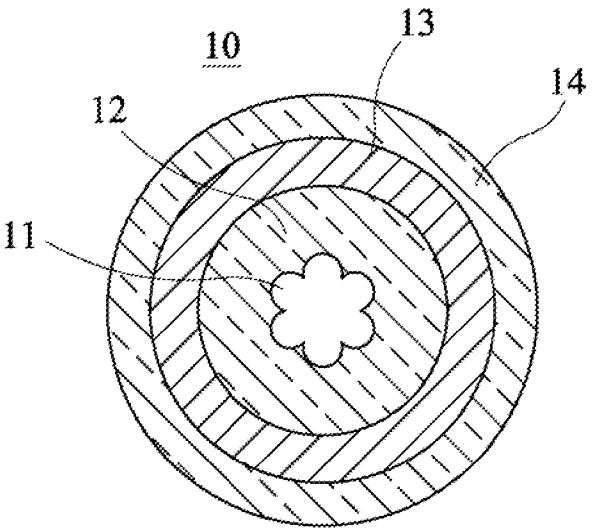
FIG. 3 is an enlarged view showing the cross section of a coaxial cable constituting the flat cable in FIG. 1.
Figure 4:
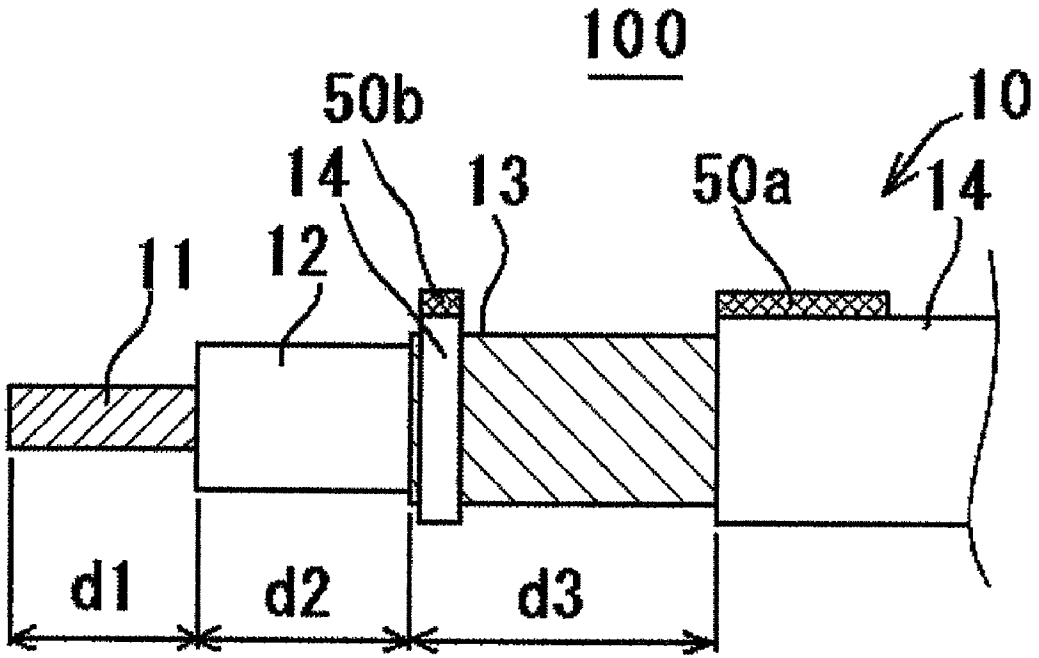
FIG. 4 is an enlarged view showing a side of one tip of the flat cable in FIG. 1.

FIG. 1 is a plan view showing an embodiment of a flat cable according to the present invention, FIG. 2 is a cross-sectional view thereof along line A-A, FIG. 3 is an enlarged view showing the cross section of a coaxial cable constituting the flat cable, and FIG. 4 is an enlarged view showing a side of one tip of the flat cable. This flat cable 100, as shown in FIGS. 1 and 2, has a plurality of coaxial cables 10 arranged in parallel at predetermined pitches, and having their both end portions securely disposed on laminate sheets 50, respectively. That is, each coaxial cable 10 has a strip-shaped laminate sheet 50*a* secured entirely across the flat cable along the inner side of a machined edge portion of a flat cable edge-machined portion K for electric connection, and a band-shaped laminate sheet 50*b* secured entirely across the flat cable at a middle portion of the flat cable edge-machined portion K.

As shown in FIG. 3, the coaxial cable 10 has a dielectric layer 12 of an insulating material formed around a center conductor 11 formed by twisting a plurality of conductors, has a shield layer 13 by laterally winding a plurality of conductive wires about the outer surface of the dielectric layer 12, and a jacket 14 of an insulating material formed on an outer surface of the shield layer 13. The coaxial cable 10 has a very narrow diameter of, for example, 0.15 mm to 0.5 mm or so. A tetrafluoroethylene/perfluoroalkylvinylether copolymer (hereinafter called "PFA"), for example, is used as materials for the dielectric layer 12 and the jacket 14.

As shown in FIG. 2, the laminate sheet 50 has a double-layer structure having a base layer 52 and a bonding layer 51. The base layer 52 is an ultrathin sheet having, for example, a porous polytetrafluoroethylene (hereinafter called "EPTFE") film processed to a thickness of 30 μm to 100 μm. The EPTFE film can be acquired by expanding a source material, polytetrafluoroethylene (hereinafter called "PTFE"), and is a fluororesin film having minute continuous porous structure. The EPTFE film has excellent characteristics on heat durability, chemical resistance, weather resistance, and so forth, and shows excellent durability, good plasticity and very high flexibility even when it is processed to an ultrathin sheet of 30 μm to 100 μm in thickness.

The bonding layer 51 is formed on that side of the base layer 52 where the coaxial cable 10 is fixed, and is a bonding layer having a thickness of 10 μm to 50 μm and formed of a tetrafluoroethylene/hexafluoropropylene copolymer (hereinafter called "FEP"), for example. The bonding layer 51 of FEP can easily and securely bond the jacket 14 of the coaxial cable 10 of PFA to the base layer 52 of EPTFE by thermal adhesion. The thermal-adhesion based bonding can allow a part of the laminate sheet 50 to be subjected to laser processing after adhesive bonding to separate that part.

The flat cable 100 will be described in further detail referring to FIG. 4. Both end portions of each coaxial cable 10 are subjected to a cable edge machining process for electric connection. That is, at a portion of a predetermined distance d1 from the tip of the flat cable, the laminate sheet 50, the jacket 14, the shield layer 13 and the dielectric layer 12 are peeled off to expose the center conductor 11. Further, at a portion of a predetermined distance d2 from the base of the center conductor 11, the laminate sheet 50, the jacket 14 and the shield layer 13 are peeled off to expose the dielectric layer 12. Furthermore, at a portion of a predetermined distance d3 from the base of the dielectric layer 12, the laminate sheet 50 and the jacket 14 are peeled off to expose the shield layer 13.

Then, at a portion inward of the base of the shield layer 13, the strip-shaped laminate sheet 50*a* entirely across the flat cable is made to remain secured to the jacket 14. Further, at a portion near the tip of the shield layer 13, the band-shaped laminate sheet 50*b* entirely across the flat cable is made to remain secured to the jacket 14.

According to the flat cable 100 with the structure, the shield layer 13 exposed between the strip-shaped laminate sheet 50*a* and the band-shaped laminate sheet 50*b* is held by the jacket 14 with a predetermined width left at the tip side of the shield layer 13, making it possible to prevent multiple laterally wound ultrathin conductive wires constituting the shield layer 13 from raveling apart. Further, because a plurality of coaxial cables 10 at an end portion of the flat cable 100 are held by the band-shaped laminate sheet 50*b*, the coaxial cables are not separated from one another and can be held at predetermined positions and the pitches formed between the coaxial cables can be kept accurately, thus making it possible to enhance the connection reliability and facilitate the connection work at the time of connecting a contact of connector to the center conductor 11 for signal line connection, and to enhance the connection reliability and connection workability at the time of collectively connecting a grand bar to the shield layers 13 of the individual coaxial cables 10 for ground connection.

Figure 5:
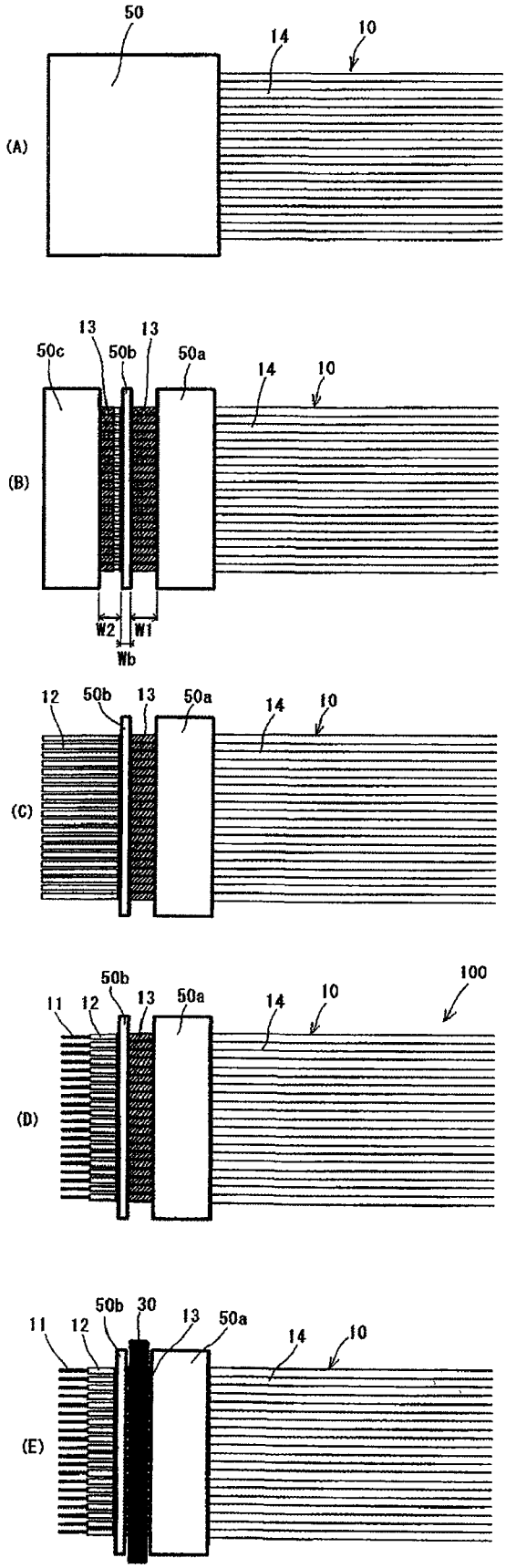
FIG. 5 is a diagram illustrating processes of processing the flat cable in FIG. 1.

FIG. 5 is a diagram illustrating processes of processing the flat cable 100. Although FIG. 5 shows only one end side of the flat cable 100, the other end is similarly processed. First, as shown in FIG. 5(A), the individual coaxial cables 10 are arranged in parallel, with their end portions aligned, on the bonding layer 51 side (back side in the diagram) of the rectangular-shaped laminate sheet 50, and the bonding layer 51 of the laminate sheet 50 is securely bonded to the jackets 14 of the coaxial cables 10.

Next, as shown in FIG. 5(B), the strip-shaped laminate sheet 50*a* and the band-shaped laminate sheet 50*b* are formed using a laser beam machine or the like. That is, for example, carbon dioxide gas laser processing is performed entirely across the flat cable by a predetermined width w1 toward the tip of the flat cable from a position of a predetermined distance (distance to be subjected to the cable edge machining process) as viewed from the tip of the flat cable to thereby remove the laminate sheet 50 and the jacket 14 of each coaxial cable 10 by the predetermined width w1. This can form the strip-shaped laminate sheet 50*a* and expose the shield layer 13 of each coaxial cable 10 at the portion of the predetermined width w1.

At this time, simultaneously, carbon dioxide gas laser processing, for example, is performed entirely across the flat cable by a predetermined width w2 toward the tip of the flat cable from the tip side of the predetermined distance w1, with a predetermined width wb of the band-shaped laminate sheet 50*b* excluded, to thereby remove the laminate sheet 50 and the jacket 14 of each coaxial cable 10 by the predetermined width w2. This can form the band-shaped laminate sheet 50*b* and expose the shield layer 13 of each coaxial cable 10 at the portion of the predetermined width w2. Then, for example, YAG laser processing is performed entirely across the flat cable along the tip side of the band-shaped laminate sheet 50*b* to cut the shield layer 13 of each coaxial cable 10.

Next, as shown in FIG. 5(C), the tip of each coaxial cable 10, i.e., the jacket 14 and the shield layer 13 on the tip side from the band-shaped laminate sheet 50*b* can be removed by pulling out the laminate sheet 50*c* on the tip side of the flat cable. This makes it possible to expose the dielectric layer 12 of each coaxial cable 10 on the tip side of the band-shaped laminate sheet 50*b*.

Then, as shown in FIG. 5(D), for example, carbon dioxide gas laser processing is performed entirely across the flat cable by a predetermined width w3 toward the tip of the flat cable from a position of a predetermined distance as seen from the tip of the flat cable to thereby remove the dielectric layer 12 of each coaxial cable 10 by a portion of the predetermined width w3, thereby exposing the center conductor 11. This completes the flat cable 100.

Further, as shown in FIG. 5(E), the shield layer 13 of each coaxial cable 10 exposed between the strip-shaped laminate sheet 50*a* and the band-shaped laminate sheet 50*b* may be held from above and under with two approximately plate-like grand bars 30 of a metal, e.g., tin-plated phosphor bronze, and the grand bars 30 and the shield layers 13 of the coaxial cables 10 may be collectively connected by soldering or the like to provide a securely bonded flat cable.

In this case, the shield layer 13 between the band-shaped laminate sheet 50*b* and the machined edge portion of the flat cable edge-machined portion is held between the jacket 14 or the band-shaped laminate sheet 50*b*, and in a case of securely bonding the grand bar 30 on the shield layer 13, there is no position deviation in the lengthwise direction of the cable. Even in a case of heating and melting a solder, there is no position deviation in the lengthwise direction of the cable so that a flat cable with a high bonding position precision for the grand bar 30 can be provided without causing a size defect originating from deviation of the grand bar 30 on the shield layer 13.

Because the above-described mode can suppress a variation in pitch between the coaxial cables 10, it is possible to collectively and easily execute electric processes, such as signal line connection and ground connection of a plurality of coaxial cables 10. Although the foregoing embodiment has a one-side laminate sheet structure, another laminate sheet 50 may be prepared to ensure a double-side laminate sheet structure which holds the coaxial cables 10 from above and under to securely bond them. Further, although the laminate sheet 50 is structured to be bonded only at a cable end portion, the structure in which the laminate sheet 50 is bonded entirely along the cable length can be adapted similarly.

In the flat cable 100 according to the embodiment, the number of the coaxial cables 10 to be fixed by the grand bars 30 is not particularly limited. While a flat cable having 20 to 50 or so coaxial cables is used for a cellular phone, for example, a flat cable having a greater number of coaxial cables is used for a notebook type personal computer, and the flat cable 100 according to the embodiment can be adapted to either case.

An example of the present invention will be explained next.

Example

The flat cable 100 was prepared by providing the dielectric layer 12 of PFA with a thickness of about 50 μm around the outer surface of the center conductor 11 having stranded seven conductors with a diameter of 25 μm, winding 20 conductive wires with a diameter of 30 μm around the outer surface of the dielectric layer 12 to form the laterally wound shield layer 13 as an external conductive layer, and fixing 40 ultrathin coaxial cables 10 each having the jacket 14 of PFA with a thickness of about 35 μm provided on the outer surface of the shield layer 13, at cable pitches of 0.4 mm, only one side with the laminate sheets 50*a*, 50*b* of EPTFE having a thickness of 80 μm. Such a flat cable 100 could prevent the individual coaxial cables 10 from raveling apart at the time cable edge machining was executed for signal line connection and ground connection of the center conductors 11 of the individual coaxial cables to, for example, the contacts or the like of a connector, so that the connection work could be easily and surely carried out.

Although an embodiment and an example of the present invention have been described above, the flat cable 100 according to the present invention has at least end portions of a plurality of coaxial cables 10 securely arranged in parallel on the laminate sheet 50, and has the laminate sheet 50*b* made to remain in a band shape entire across the cable at middle portions of the flat cable edge-machined portions of the coaxial cables 10 for electric connection. That is, a plurality of coaxial cables 10 exposed at an end portion of the flat cable 100 by the cable edge machining process are fixed to the laminate sheet 50*b* formed by making the individual middle portions remaining in a band shape. It is therefore difficult for the individual coaxial cables to be separated at the end portion of the flat cable 100, making it possible to keep high pitch precision among the coaxial cables and easily and surely carry out complex and troublesome electric connections.

The individual coaxial cables 10 on the band-shaped laminate sheet 50*b* can have the jackets 14 kept secured to the band-shaped laminate sheet 50*b*, so that the coaxial cables 10 can be put together at an end portion of the flat cable 100. Because the dielectric layer 12 and the center conductor 11 of each coaxial cable 10 are exposed between the band-shaped laminate sheet 50*b* and the tip of the flat cable, and the shield layer 13 of each coaxial cable 10 is exposed between the band-shaped laminate sheet 50*b* and the machined edge portion of the flat cable edge-machined portion, it is possible to prevent multiple laterally wound ultrathin conductive wires forming the shield layer 13 from raveling apart. The metal grand bars 30 are connected between the band-shaped laminate sheet 50*b* and the machined edge portion of the flat cable edge-machined portion for collective grounding to the shield layer 13, thus making it possible to easily and surely achieve ground connection of the shield layer 13.

The scope of the present invention is not limited to the embodiment and example described above, and the invention can be adapted to various other embodiments without departing from the descriptions of the claims.

INDUSTRIAL APPLICABILITY

The flat cable according to the present invention can be used in electronic devices, such as a cellular phone and a personal computer, and can be adapted to an automobile field or the like.

The invention claimed is:

1. A flat cable in which at least end portions of a plurality of coaxial cables are securely arranged in parallel on a sheet, characterized in that a flat cable edge-machined portion for electric connection of the coaxial cables is formed at the end portion of the plurality of coaxial cables, and a part of the sheet is made to remain in a band shape across an entire width of the flat cable between a machined edge portion of the edge-machine portion and a distal end of the flat cable, and a jacket of the coaxial cable is secured to the band-shaped sheet.

2. The flat cable according to claim 1, wherein the coaxial cables on the band-shaped sheet has not been subjected to a cable end process.

3. The flat cable according to claim 1 or 2, wherein a dielectric layer of the coaxial cable, or the dielectric layer and a center conductor are exposed between the band-shaped sheet and the distal end of the flat cable, and a shield layer of the coaxial cable is exposed between the band-shaped sheet and the machined edge portion of the flat cable edge-machined portion.

4. The flat cable according to claim 3, wherein a metal bar for collective connection to the shield layer is connected between the band-shaped sheet and the machined edge portion of the flat cable edge-machined portion for collective grounding.

* * * * *